United States Patent [19]

Cavagna

[11] Patent Number: 4,823,665

[45] Date of Patent: Apr. 25, 1989

[54] DEVICE FOR THE ALTERNATE POSITIONING OF THE BLADE EDGE IN A CUTTING MACHINE

[75] Inventor: Elio Cavagna, Melegnano, Italy

[73] Assignee: Elio Cavagna S.R.L., Melegnano, Italy

[21] Appl. No.: 145,474

[22] Filed: Jan. 19, 1988

Related U.S. Application Data

[63] Continuation-in-part of Ser. No. 810,655, Dec. 18, 1985, abandoned.

[51] Int. Cl.[4] ..... B26D 1/02

[52] U.S. Cl. ..... 83/529; 83/563; 83/639; 83/856

[58] Field of Search ..... 83/425, 433, 527, 529, 83/530, 546, 563, 856, 858, 639

[56] References Cited

U.S. PATENT DOCUMENTS

| | | | |
|---|---|---|---|
| 3,054,317 | 9/1962 | Castle, Jr. | 83/640 |
| 3,094,889 | 6/1963 | Elsas | 83/529 |
| 4,094,217 | 6/1978 | Exline | 83/856 |
| 4,422,359 | 12/1983 | Leboeuf | 83/546 |
| 4,505,172 | 3/1985 | De Guchi | 83/74 |

*Primary Examiner*—Frank T. Yost
*Assistant Examiner*—Hien H. Phan
*Attorney, Agent, or Firm*—Bucknam and Archer

[57] ABSTRACT

The device for positioning the blade cutting edge and intermittently lowering the blade cutting edge includes: a fixed structure comprising two chambers and a central moving rod; two pistons with stems, the pistons moving within the chambers. One of the pistons is opposed by a spring. The blade carrier is hinged at the end of the moving rod and is fixed to the piston stem opposed by the spring and slides along the stem of the other piston. Pressurized fluid is introduced into the chambers by a line provided with a first valve. A second valve intermittently varies the pressure applied to the piston opposed by the spring.

1 Claim, 2 Drawing Sheets

DEVICE FOR THE ALTERNATE POSITIONING OF THE BLADE EDGE IN A CUTTING MACHINE

This application is a continuation-in-part of U.S. Ser. No. 810,655 which was filed Dec. 18, 1985 now abandoned.

BACKGROUND OF THE INVENTION

1. Field of the Invention

The present invention refers to a device for positioning the blade edge of a cutting machine and intermittently lowering the blade cutting edge. More particularly this invention refers to a device for positioning and intermittently lowering the blade "edge" for the continuous cutting of films, or very thin films suitable for the packing of various products.

2. Description of the Prior Art

Different devices are known, that may be termed "blade carriers", which, in a mobile manner, support a thin cutting "blade" designed to cut film-like material, to obtain strips to be used generally in the packing of various products.

To achieve the alternate movements of the blade fitted on a "blade-carrier" the known devices use a series of cams that mechanically impart the desired movement to the blade-carrier in order to sequentially move the position of the blade during the cutting operation.

Other devices are also known which are not fitted with alternate mechanical controls, but that require periodic displacement of the blade along the blade-carrier, to change the position in which the "edge" cuts the film.

All these known devices have different drawbacks and limitations. In fact, the devices where the alternating movements of the blade-carrier are achieved mechanically, include a shaft to operate the numerous cams.

Generally, the shaft requires complex and costly processing and may have a considerable longitudinal size to be used in the various types of blade carrier to be operated.

Therefore, the said devices are mechanically complicated and difficult to position and calibrate.

Whereas, on the other hand, in the case of blade-carrier devices in which recourse is made to the repeated displacement of the blade in the blade-carrier, there are consequently frequent interruptions in the film cutting operations. In addition, in the known devices a straight cut by the blade is not assured, since the movements of the blade-carrier are not rationally guided.

SUMMARY OF THE INVENTION

According to this invention, the drawbacks and the limitations described above are overcome by an improved device wherein the positioning and the intermittently lowering of the blade-carrier and consequently of the blade cutting edge is achieved by the action of a pressurized fluid, such as compressed air.

The improved device of the present invention includes: a fixed structure comprising two chambers and a central moving rod; means to supply a pressurized fluid into the chambers; two pistons with stems, the pistons moving within the chambers and one of the said pistons being opposed by a return spring; and a blade-carrier hinged at the end of the central moving rod, fixed to the free end of the piston stem opposed by the spring and sliding along the stem of the other piston.

The central rod protrudes from the top of the fixed structure for a threaded portion, adjustable by a nut. This piston corresponds to the stroke of the blade-carrier and it is adjusted so that the nut meets the fixed structure in the lowering position of the blade. The lowering of the blade-carrier and its intermittently straight working positioning are assured by the fluid operated pistons and by the rod.

According to an important feature of the present invention, the device is provided with only one source of pressurized fluid, the supply line thereof is connected both to the chamber wherein the spring elastically opposed piston slides and to the chamber in which the other piston slides. The first lowering of the pistons controls the initial positioning of the blade-carrier.

The intermittently lowering of the blade-carrier is achieved by the further periodic alternate introduction of pressurized fluid, controlled by a valve, into the chamber containing the spring opposed piston. In this way, under the opposed actions of the periodic fluid pressure and of the spring, the oscillation of the blade-carrier is assured and the desired alternating of the cutting blade "edge" position is achieved. An additional control and regulating valve controls the pressurized fluid of the supply line.

Bushings, O -rings, or equivalent sealing gaskets assure the sliding and seal of the moving parts of this device. The blade carrier is shaped to form and to define the generally inclined position of the blade so as to form a shear angle. For this purpose the blade has a slot and is fixed to the blade-carrier by at least one screw that passes through the slot. The blade is fixed in the position that is sequentially achieved during the movements caused by the alternate introduction of the pressurized fluid into the chambers to obtain the sequential displacement of the blade edge as required to vary the position in which the said edge cuts the film. The device of the present invention is made integral with a bracket that slides and may be fixed in the required position on a beam, preferably having a prismatic cross-section.

BRIEF DESCRIPTION OF THE DRAWING

The above and other objects, features and advantages of the present invention will be better understood from the following description taken in conjunction with the figures of the attached drawing that illustrate a preferred, exemplificative, but non-limitating embodiment of this invention, wherein.

DESCRIPTION OF THE PREFERRED EMBODIMENT

Figures 1, 2:
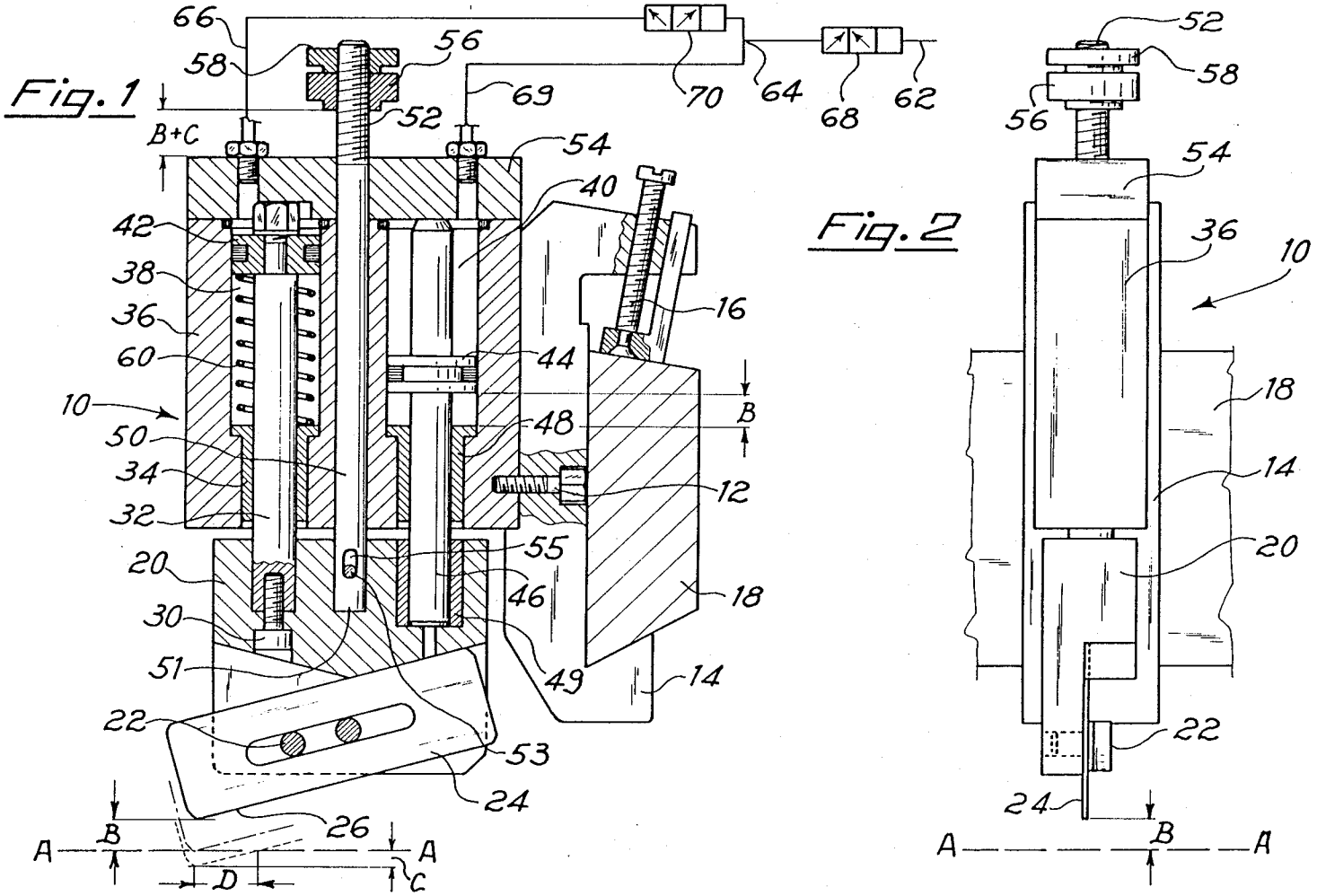
FIG. 1 represents a schematic cross-sectional view of the device of the present invention, with a plane passing through the piston axes, with the blade in the raised position.
FIG. 2 represents the schematic side view of the device of FIG. 1.

The present invention will now be described in detail below by way of example only with reference to the accompanying drawings.

The device 10 of the present invention is fixed, by means of a screw 12, to a bracket 14 that slides along a beam 18 and may be fixed thereto, in the desired position, by a screw 16.

The device 10 comprises a fixed structure or frame 36 and a shaped blade-carrier 20 to which a blade 24 is fixed by means of screws 22 with a given inclination to form a shear angle.

The cutting edge 26 of the blade 24 approaches the plane A—A which supports and on which advances the film to be cut, by the effect of its translation.

The distance between the cutting edge 26 of the blade 24 in the raised position and the supporting plane A—A is identified by the quota B; while the intermittent lowering of the blade 24 below the supporting plane A—A is defined in height by the quota C and in longitudinal direction by the horizontal quota D, that indicates the section of the cutting edge 26 that is periodically crossed by the film during the cutting operation.

The fixed structure or frame 36 comprises two parallel cylindrical chambers 38 and 40 and a central moving rod 50. A cover 54 closes the upper parts of the chambers 38 and 40, the sealing being assured by gaskets.

The lower portion 51 of the central rod 50 is hinged to the blade-carrier 20 by a pin 53 crossing out an elongated slot 55.

The upper portion 52 of the central rod 50 protrubes from the cover 54 of the structure 36 and is threaded. A regulating nut 56 and a counter-nut 58 are screwed on the threaded portion. The distance between the nut 56 and the cover surface 54 may be varied and is regulated to correspond to the sum of distances B+C, as illustrated in FIG. 1. The nut 56 regulates the total lowering of the blade-carrier 20.

A first piston 42 having a piston rod 32 is slidably mounted in the first cylindrical chamber 38. The sliding of the piston rod 32 is guided by bushings or bearings 34 fixed to the structure 36. The piston rod 32 is connected to the blade-carrier 20, for example, by means of a screw 30. The piston rod 32 is biased upwardly by means of a spring 60. The spring 60 is contained inside the chamber 38 and is arranged around the piston rod 32 between the piston 42 and the lower wall of the chamber 38, so as to oppose to the lowering movement of the piston 42.

A second piston 44 having a piston rod 46 is slidably mounted in the second cylindrical chamber 40. The distance between the piston 44 and the lower wall of the chamber 40 corresponds to the distance B between the cutting edge 26 of the blade 24 in the raised position and the supporting plane A—A, as shown in FIG. 1. Bushing or bearing 48, fixed to the structure 36, guides the sliding of the piston rod 46.

The end portion of the piston rod 46 is slidably inserted into a cylindrical chamber carried out in the blade-carrier 20. The blade-carrier 20 may freely slide along the piston rod 46 and the sliding is guided by a bushing or bearing 49 fixed to the blade-carrier 20.

A source of pressurized fluid or air 62 is connected to the upper parts of the chambers 38 and 40, above the pistons 42 and 44, through a control valve 68. The source of pressurized fluid or air 62 is divided in 64 into two supply lines: line 69 which is directly connected to the upper part of chamber 40 and line 66 which is connected to the upper part of chamber 38 through a controlling valve 70. The valve 70 controls the periodic alternate introduction of pressurized fluid or air only into the upper part of chamber 38.

As illustrated in the figures, the pistons 42 and 44 have sealing gaskets and other gaskets, particularly O-rings, are inserted between the structure 36 and its cover 54. The working cycle of the device of the present invention is as follows:

At first, the device 10 is fixed in the desired position along the beam 18 by the screw 16, and the pressurized fluid or air is fed from the source 62 to lines 66 and 69 so that pistons 42 and 44 with piston rods 32 and 46, central rod 50 and blade-carrier 20 are lowered up to the end of stroke of piston 44 (distance B), namely until piston 44 is in contact with the end of chamber 40. In this position, the cutting edge 26 of the blade 24 comes into contact with plane A—A of the running film to be cut, as shown in FIG. 1A. The position of the piston 44 is maintained fixed in the end of stroke by fluid or air pressure in the line 69 and this continues to the end of the working cycle. It should be noted that in this position the blade-carrier 20 is free to move downwardly but not upwardly.

Figure 1B:
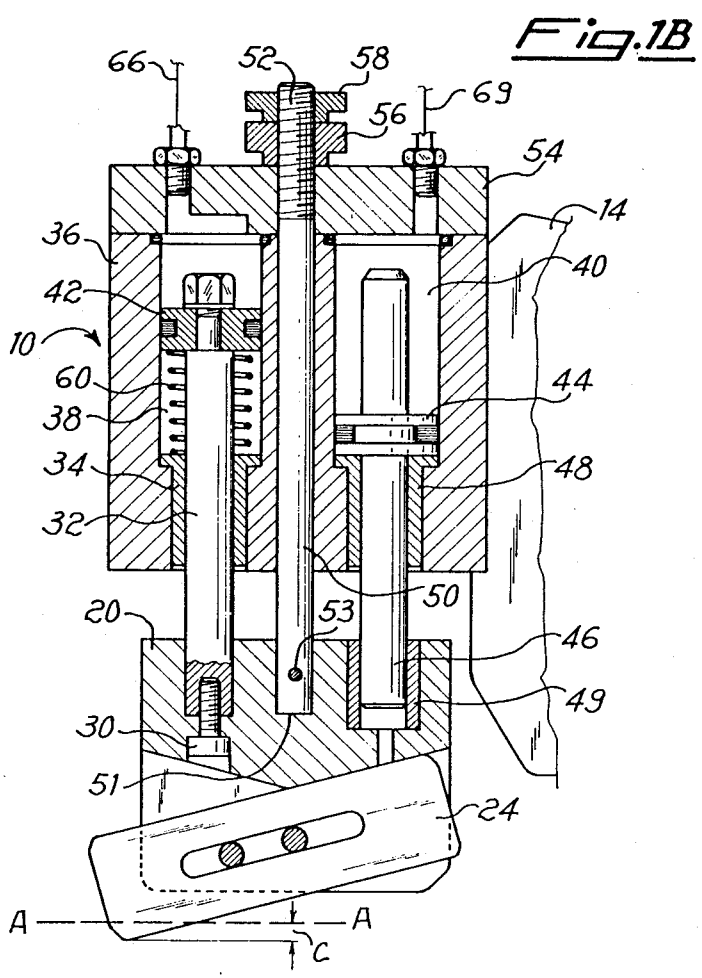
FIG. 1B represents the schematic cross-sectional view of the device of FIG. 1, with the blade in the lowered position.
Figure 1A:
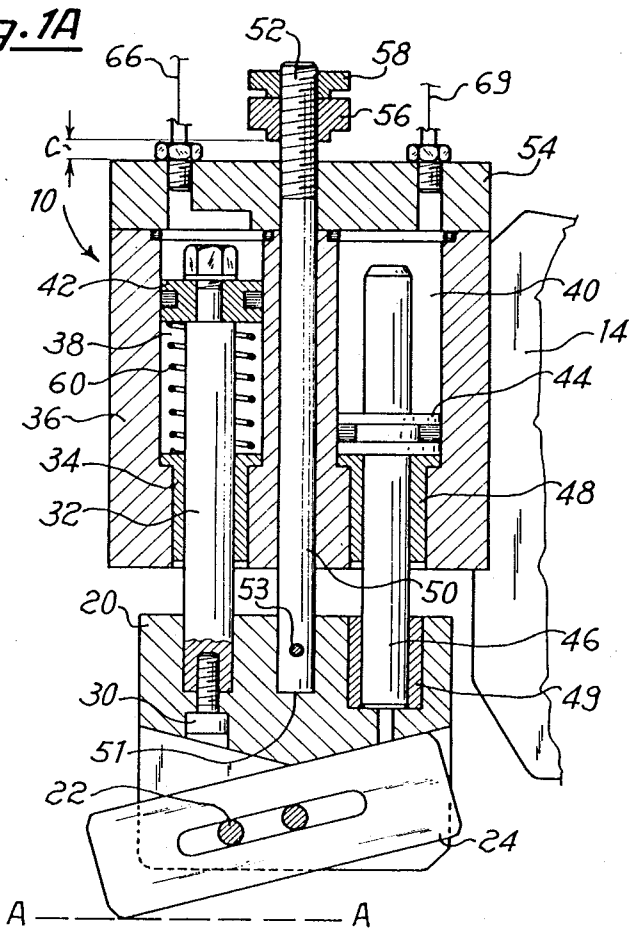
FIG. 1A represents the schematic cross-sectional view of the device of FIG. 1 with the blade cutting edge positioned to approach the cutting plane A—A.

The pressurized fluid or air is then introduced into line 66 through the control valve 70, so that the piston 42 with the piston rod 32, central rod 50 and blade-carrier 20 will be lowered until the regulating nut 56 is in contact with the cover surface 54, as shown in FIG. 1B. This lowering of the blade-carrier 20 and therefore of the cutting edge 26 occurs for the distance C. It should be noted that in this lowered position the blade-carrier 20 may move upwardly but not downwardly. Therefore, during the working cycle, the blade-carrier 20 may move from the position corresponding to the piston 44 at the end of stroke to the position corresponding to the regulating nut 56 in contact with the cover surface 54. Therefore, the distance C is defined, in the upper part, by piston rod 46 and, in the lower part, by the contact of nut 56 with cover 54. By varying the fluid or air pressure in line 66 or by periodically and alternately introducing and removing pressurized fluid or air only to or from line 66 through valve 70, the piston 42 with piston rod 32, rod 50 and blade-carrier 20 move alternatively downward and upward (oscillated) for a distance C (see FIGS. 1A and 1B) under the action of the spring 60 pressure and fluid pressure variations, so as to cause up and down alternating movements to cutting edge 26.

During the up and down alternating movements (oscillations) of the cutting edge 26, the blade-carrier 20 slides along bushing 49 fixed to said carrier 20.

From the foregoing, it is clear how the cutting edge 26, subjected to wear, is continuously renewed and the device has a prolonged working life. The construction of the device is simple in that it is only necessary to provide a controlling valve 70 for the variation of the fluid or air pressure or the periodic, alternate introduction of pressurized fluid or air only into the upper part of chamber 38. The working of the device is automatic and controlled by the fluid or air pressure and the spring reaction.

It is to be understood that the foregoing description is merely illustrative of a preferred embodiment of the invention and that the scope of the invention is not to be limited thereto, but is to be determined by the scope of the appended claims.

What is claimed is:

1. The device for automatically positioning the edge of a cutting blade into contact with the plane of a running film to be cut and causing up and down reciprocation of said blade intermittently below the running plane for a distance C, which comprises:

a fixed structure comprising a first and a second parallel cylindrical chambers and a central moving rod;

a cover closing the upper parts of the chambers;

a blade-carrier having a blade fixed thereto with an inclination corresponding to the shear angle, said blade-carrier being hinged to the lower portion of the central rod and being provided with a cylindrical chamber;

the upper portion of the central rod protruding from the cover and being threaded;

a regulating nut screwed on the threaded portion of the central rod; the distance between the nut and the cover being regulated to correspond to the total lowering of the blade-carrier;

a first piston with a first piston rod slidably mounted in the first chamber; the blade-carrier being fixed to the end of said first piston rod;

a spring contained inside the first chamber and arranged around the first piston rod to oppose to its lowering movement;

a second piston with a second piston rod slidably mounted in the second chamber, the distance between the second piston and the end wall of the second chamber corresponding to the distance between the cutting edge of the blade in the raised position and the running plane;

the end portion of the second piston rod being slidably inserted into the cylindrical chamber of the blade-carrier;

a source of pressurized fluid or air connected to the upper parts of the first and second chambers above the pistons; and a valve regulating the periodic alternate introduction of pressurized fluid or air connected with said source and with the upper part of the first chamber.

* * * * *